US005339087A

United States Patent [19]

Minarik

[11] Patent Number: 5,339,087

[45] Date of Patent: Aug. 16, 1994

[54] WAVEFRONT SIMULATOR FOR EVALUATING RF COMMUNICATION ARRAY SIGNAL PROCESSORS

[75] Inventor: Steven B. Minarik, Warminster, Pa.

[73] Assignee: The United States of America as represented by the Secretary of the Navy, Washington, D.C.

[21] Appl. No.: 145,352

[22] Filed: Oct. 27, 1993

[51] Int. Cl.[5] ..... H01Q 3/22

[52] U.S. Cl. ..... 342/375; 342/360; 342/172

[58] Field of Search ..... 342/172, 360, 375

[56] References Cited

U.S. PATENT DOCUMENTS

| | | | |
|---|---|---|---|
| 4,912,478 | 3/1990 | Daniel | 342/375 |
| 5,177,488 | 1/1993 | Wang et al. | 342/167 |
| 5,223,840 | 1/1993 | Cronyn | 342/170 |

*Primary Examiner*—Theodore M. Blum
*Attorney, Agent, or Firm*—James V. Tura; James B. Bechtel; Susan E. Verona

[57] ABSTRACT

A wavefront simulator that emulates plane wave propagation from multiple transmitting antennas is used to evaluate, in both a static and a dynamic manner, an array processor used in RF communications to determine the location of transmitting antennas and possibly to perform beamforming for cancelling the energy of an interfering transmitter. The wavefront simulator generates time delay signals, giving the appearance of being emitted from different transmitters or sources, and simulates those signals as being received by an antenna array associated with the array processor. The array processor utilizes the time delay signals to calculate, e.g., the angle of arrival of the signals from the emitting antennas.

6 Claims, 6 Drawing Sheets

WAVEFRONT SIMULATOR FOR EVALUATING RF COMMUNICATION ARRAY SIGNAL PROCESSORS

The invention described herein may be manufactured and used by and for the Government of the United States of America for governmental purposes without the payment of any royalty thereon or therefore.

BACKGROUND OF THE INVENTION

The present invention relates to a simulator and, more particularly, to a simulator that emulates RF signals that are used to evaluate the operational response of a RF communication array signal processor.

Array signal processors are used in RF communications systems to determine the location of emitters or possibly for beamforming for cancelling the energy of an interfering transmitter. Array signal processors have various operational responses to determine selected parameters of received RF signals, but all array processors have a common requirement to process signals received from an array of multiple antennas that may be at a fixed location or may be mounted on an aircraft. Many signal processors have at least one operational response that uses the time delay between the signals received from the array of multiple antennas that originated from fixed or mobile transmitters. The time delay between the signals may be used either to determine the received signal's angle of arrival, or to steer, on a dynamic basis, the antenna pattern of the array receiving the signals.

Array signal processors, in order to transition from their design concept to their final deployable product, must undergo evaluation testing which may be expensive and costly, especially if the array signal processor is placed on an aircraft. For example, flight testing needs to be performed in order to properly evaluate an airborne array signal processor. Not only are these flight tests expensive, but also the flight testing does not lend itself to repetitive situations which are necessary in order to properly evaluate the response of the array signal processor. Furthermore, the response of the antenna array associated with array signal processors should be evaluated relative to the positions of transmitters that emit the radiating signal which, in turn, requires that the transmitters be physically located miles away from the array signal processor being evaluated.

The antenna array, normally consisting of four antennas, must also be evaluated to determine its operation in a selected frequency range, for example, between 160–180 MHz. The antenna arrays should be evaluated in an environment of being mounted at a stationary (static) location or evaluated as being movable (dynamic) on, for example, an aircraft that is in motion relative to a fixed location. Not only should the antenna array be evaluated on a static and dynamic basis, but the transmitting devices of the signal array processors should also encounter static and dynamic evaluations.

Furthermore, since the accuracy of the RF simulator will determine the accuracy of the array signal processors under test, the simulator should be evaluated on a periodic basis by calibration equipment. Therefore, it is important that the RF simulator, which generates signals incident on an antenna array, allow itself to be easily calibrated. This process will verify that the correct time delays between antennas are generated. It is desired that an array signal processor for RF communication be provided with a simulator having all of the hereinbefore described features so as to perform a proper evaluation of the communication processor.

SUMMARY OF THE INVENTION

The present invention is directed to a simulator that emulates the RF signals which are used to evaluate an RF communication array signal processor.

The invention is particularly suited for evaluating an RF communication array signal processor that is mounted on an aircraft. The simulator comprises at least one splitter that receives its signal at a predetermined frequency band, in the megahertz region, and splits the signal into two output signals. The simulator further comprises at least one adjustable delay line and at least one digital delay line. The adjustable delay line receives one signal from the splitter and has a preselectable time delay. The delay line receives the other signal from the splitter and introduces a controlled time delay. These two signals are made available to the array signal processor. The signal used to control the digital time delay is varied in a prescribed manner by an operating computer on a real-time basis. The response of the RF communication array signal processor to the generated time differential output signals is evaluated by recording devices.

The invention further comprises a method that varies the time delay between the signals from the adjustable line length and digital delay and evaluates the array signal processor's response to these signals.

Accordingly, it is an objective of the present invention to provide a simulator which evaluates an RF communication array signal processor's capability, operating on a real time basis, to respond to time delay signals received from an array of multiple antennas.

Another objective of the present invention is to provide a simulator capable of evaluating an RF communication array signal processor that may be used on an aircraft without the need of expensive, time consuming, and somewhat limited flight tests.

It is a further objective of the present invention to provide a simulation of a four element antenna array operating in a frequency range between 160 and 180 MHz. This antenna array may be particularly suited for being mounted on an aircraft.

Still further, it is an objective of the present invention to provide a simulator having features that make it amenable to being calibrated so as to ensure the proper maintenance of the accuracy of the RF communication array signal processor.

Other objectives, advantages and novel features will become apparent from the following detailed description when considered in conjunction with the accompanying drawings.

DETAILED DESCRIPTION OF THE PREFERRED EMBODIMENTS

Figure 1:
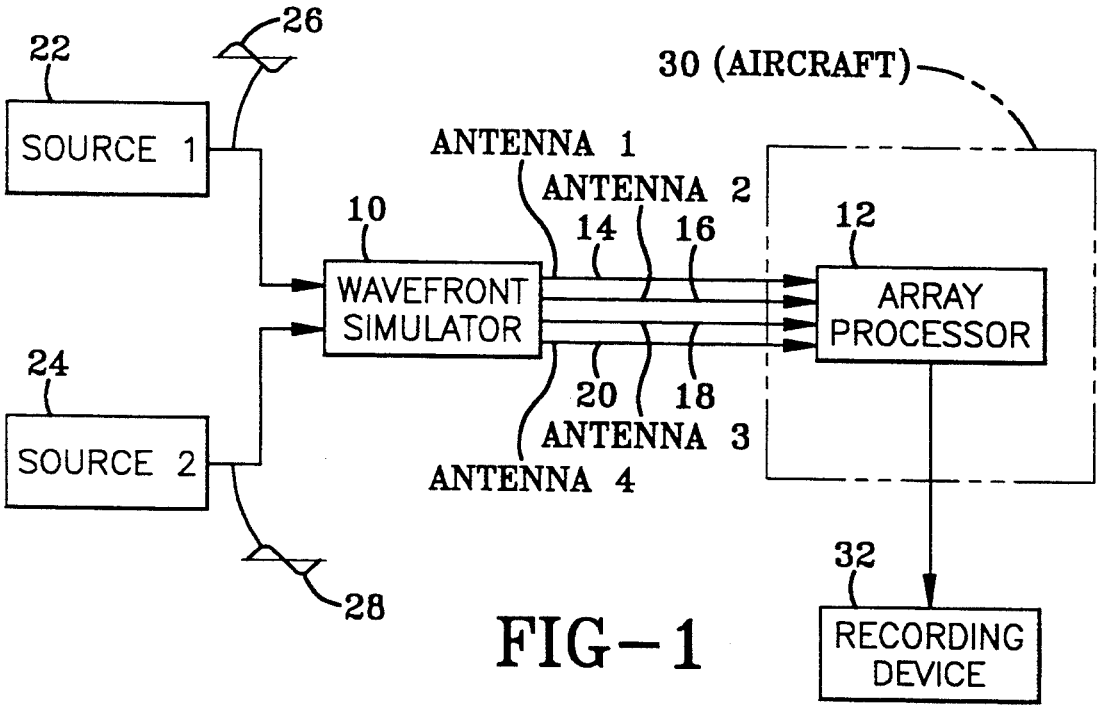
FIG. 1 is a block diagram illustrating the interconnections of the wavefront simulator of the present invention.

With reference to the drawing, wherein the same reference numbers are used to indicate the same elements, FIG. 1 illustrates the interconnection of the wavefront simulator 10 of the present invention to its related equipment.

In general, the wavefront simulator 10 emulates plane wave propagation from multiple transmitting antennas (sources) and is used to evaluate an RF communication array signal processor 12 which determines the location of the transmitting antennas, or may even perform beamforming for cancelling the energy of an interfering transmitter. The wavefront simulator 10 is not only used to evaluate an RF communication array signal processor 12, but may also be used to evaluate other equipment related to RF communications. The wavefront simulator 10 generates time delay signals that give the appearance that they are being emitted from different transmitting RF sources and being received by an antenna array associated with the array processor 12 being evaluated. The array processor 12 utilizes the time delay between the received signals at the antenna array to calculate, among other things, the angle of arrival of the received signals emitted from the transmitters or to steer, on a dynamic basis, the antenna array associated with the array processor 12.

FIG. 1 illustrates the wavefront simulator 10 as being connected to the array processor 12 by means of signal paths 14, 16, 18 and 20 respectively labeled antenna 1, antenna 2, antenna 3 and antenna 4. The wavefront simulator 10 has its input stage connected to sources 22 (source 1) and 24 (source 2), each of which generates signals 26 and 28 respectively at a predetermined frequency band in the megahertz range and, preferably, at a frequency band of 160–180 MHz. Each of the sources 22 and 24 simulates RF signals normally emitted from a transmitter. The array processor 12, particularly suited to be mounted on an aircraft 30, accepts and responds to the signals generated by the wavefront simulator 10. The correct or incorrect response is determined by a recording device 32 appropriately connected to the array signal processor 12. The response of the array processor 12 is determined by a variety of parameters some of which have symbols and all of which have a general definition both of which are given in Table 1.

TABLE 1

| Symbol | General Definition |
|---|---|
| j | Subscript associated with a source |
| i | Subscript associated with an antenna |
| $D_{ji}$ | Distance between source j and antenna i |

TABLE 1-continued

| Symbol | General Definition |
|---|---|
| $T_{ji}$ | Source-to-antenna time delay |
| c | Speed of light |
| $x_{ai}, y_{ai}, z_{ai}$ | Position of an antenna i in the aircraft coordinate frame |
| $X_{ai}, Y_{ai}, Z_{ai}$ | Position of an antenna i in a fixed rectangular coordinate frame |
| $X_p, Y_p, Z_p$ | Position of an aircraft in a fixed rectangular coordinate frame |
| $\Theta$ | Aircraft heading relative to a reference axis |
| $X_j, Y_j$ | Position of a source j in a fixed rectangular coordinate frame |
| $P_{1i}$ | Phase difference between antenna 1 and antenna i |
| f | Frequency of the transmitter |
| $\Delta_{j1i}$ | Time delay between antenna 1 and antenna i due to source j |

Figure 2:
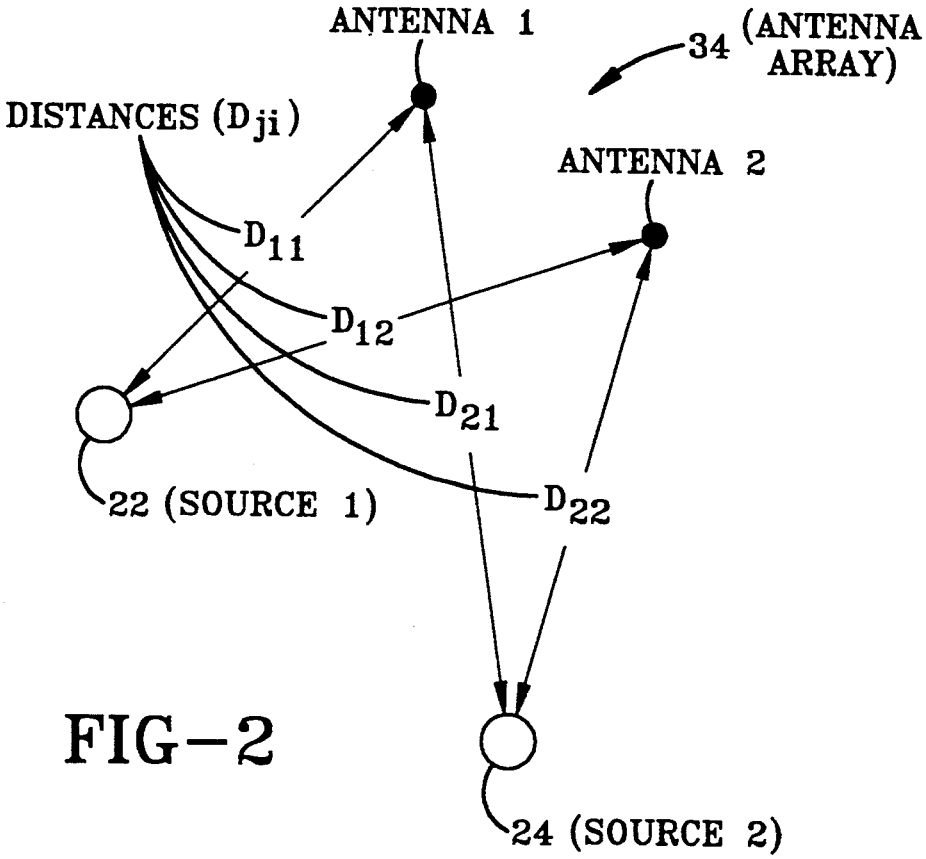
FIG. 2 is a schematic illustration showing a simple example of the distances separating the sources (transmitters) and antennas related to the present invention.

The operation of the wavefront simulator 10 may be further described with reference to FIG. 2 which is a schematic illustrating a simple example that includes two transmitting sources 22 and 24 and an aircraft antenna array 34 shown as comprising at least antenna 1 and antenna 2. As seen in FIG. 2, the sources 22 and 24 (having a subscript j) and the antennas 1 and 2 (having a subscript i), are separated from each other by distances $D_{ji}$, e.g., $D_{11}$, $D_{12}$, $D_{21}$ and $D_{22}$. The distances $D_{ji}$ are determined by the time delay between antennas 1 and 2 due to the signals generated by sources 22 and 24. The associated source-to-antenna time delays are herein termed $T_{ji}$, having the following relationship given by the below expression (1), wherein the term c is the speed of light:

$$T_{ji}=D_{ji}/c \qquad \text{Expression 1}$$

The parameter of interest of the wave front simulator 10 is the differential time delay between a source and each antenna. With reference to FIG. 2, for source 1, the difference in time delay between the transmitted signal arriving at antennas 1 and 2 has the following relationship given by the below expression (2):

$$\Delta_{112}=T_{11}-T_{12}=1/c\,(D_{11}-D_{12}) \qquad \text{Expression 2}$$

With regard to FIG. 2, for source 2, the difference in time delay between the transmitted signal arriving at antennas 1 and 2 has a relationship given by the below expression (3):

$$\Delta_{212}=T_{21}-T_{22}=1/c\,(D_{21}-D_{22}) \qquad \text{Expression 3}$$

Typical negative values that may be calculated from expressions (2) or (3) indicate that the transmitter (source) is closer to antenna 1 than antenna 2, whereas positive values indicate that the transmitter (source) is closer to antenna 2 than antenna 1. The array processor 12 utilizes the time delays of the signals between the antennas to determine the angle of arrival of the signal from each of the sources. Therefore, to emulate an appropriate RF environment to evaluate the response of the array processor 12, the time delays of expressions (2) and (3) are varied and the ability to accomplish such variation is provided by the wavefront simulator 10 of the present invention. The wavefront simulator 10 provides the appropriate and variable signals to each antenna 1 and 2, of FIG. 2 which, in turn, are routed to the array processor 12 under evaluation. The basic operation of the wavefront simulator 10 to supply these appropriate and variable signals may be further described with reference to FIG. 3, which illustrates a single source (1) and two antennas 1 and 2.

Figure 3:
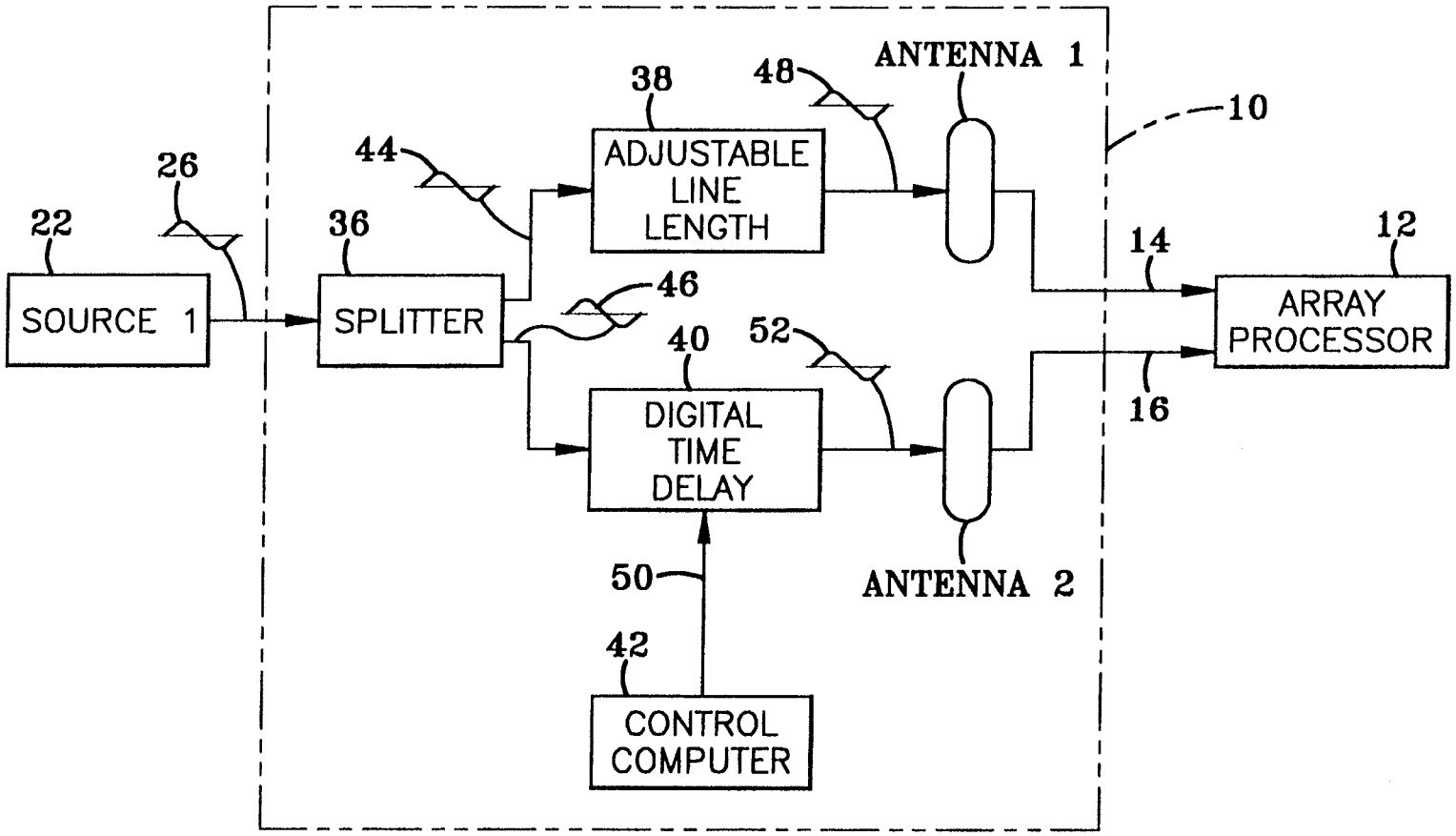
FIG. 3 is a block diagram showing the arrangement of the basic elements of the simulator of the present invention.

As seen in FIG. 3, the wavefront simulator 10 comprises a splitter 36, an adjustable line length device 38, a digital time delay 40 and a computer control 42. In addition, actual antennas 1 and 2 may be provided, but more preferably, the wavefront simulator 10 directly provides the processor 12 with signals that represent the proper response of antennas 1 and 2. FIG. 3 illustrates antennas 1 and 2 as being directly input to the array processor 12.

The splitter 36, sometimes referred to as a power splitter, receives the first output signal 26 from source 1, having a predetermined frequency in the megahertz range, and splits the signal into two signals 44 and 46 which are respectively routed to the adjustable line length device 38 and to the digital time delay 40. The adjustable line length device 38 is a fixed length of cable to be determined as described later. The digital time delay 40 is a common RF device. The adjustable length line length provides an adjustable and preselectable delay so that the propagation time of a signal entering and leaving the device 38 is adjustable. Similarly, the digital time delay 40 also provides an adjustable delay (progation time) but in response to a control signal generated by an external source, such as control computer 42. The control computer 42 is preferably a computer work station having a typical computer network with input, output and calculation provisions all exercised during the evaluation process, to be described, performed by wavefront simulator 10.

The adjustable line length 38 has a preselected time delay and develops an output signal 48 that is made available to the signal processor 12 on signal path 14 or which may be first routed to antenna 1 which, in turn, provides the signal on path 14. The digital time delay 40 is responsive to a control signal 50 and develops an output signal 52 that is made available to the array processor 12 on signal path 16, or, which may be first routed to antenna 2 which, in turn, provides the signal on path 16.

The signal 26 is split, by the splitter 36, into two paths, with the first being the upper path comprising signals 44 and 48 and emulating the signal transmission to antenna 1, and the second path comprising signals 46 and 52 emulating the signal transmission to antenna 2. The lower path to antenna 2 passes through the digital time delay 40, which is used to control the time difference between the signals arriving at antennas 1 and 2. The digital time delay 40 is controlled by the control signal 50 comprising an eight (8) bit word having a decimal value in the range from 0 to 255 and generated by the control computer 42. The digital time delay 40 accepts the eight (8) bit word generated by the control computer 42, which is part of a computer work station, and uses the contents of such word to establish the time delay to which the entering signal 46 encounters before it exits as signal 52. In one embodiment, the maximum delay of time delay 40 is 6,226 nanoseconds (nsec) which corresponds to a digital control word of decimal 255. The least significant bit of the digital word is 24.4 picoseconds (psec) so that the delay provided by the digital time delay 40 may be incremented in 24.4 psec steps. The 6.226 nsec time delay is electrically equivalent to 358.6° phase shift between the output signals having as their source signal 26 with a frequency of 160 MHz.

In order for the transmitted signal 26 to reach antenna 1 before antenna 2 (indicating that the source 22 is closer to antenna 1) the time delay provided by the digital time delay 40 must be negative. To obtain negative and positive time delay, the line length, provided by adjustable line length device 38, is selected such that when a control word 50, having a digital content of 128 (a delay of 3.125 nsec), is sent to the digital time delay 40, the time difference in which the transmitted signal reaches antenna 1 and 2 is zero seconds. In this case, the transmitted signal 26 reaches antennas 1 and 2 simultaneously. Therefore, when control word 50, having a digital content of zero (0), is sent to the digital time delay 40, the transmitted signal 26 will reach antenna 2 at a time which is 3.125 nsec before the transmitted signal 26 reaches antenna 1. Furthermore, when the contents of signal 50 represents a digital quantity of 255, the transmitted signal 26 reaches antenna 1 at a time which is 3.101 nsec before it reaches antenna 2.

The circuit arrangement of FIG. 3 may be used to implement analysis of the parameters of expressions (2) and (3) and the differential time delay of expressions (2) and (3) may range from −3.125 nsec to +3.101 nsec in 24.4 picosecond incremental steps. It should be noted that the absolute time delay between sources (1 and 2) and antennas (1 and 2) need not be generated because it is only necessary to generate the time differences between a source and each antenna in order to properly evaluate the array processor 12. A circuit arrangement that is used to simulate two sources and four antennas may be further described with reference to FIG. 4.

Figure 4:
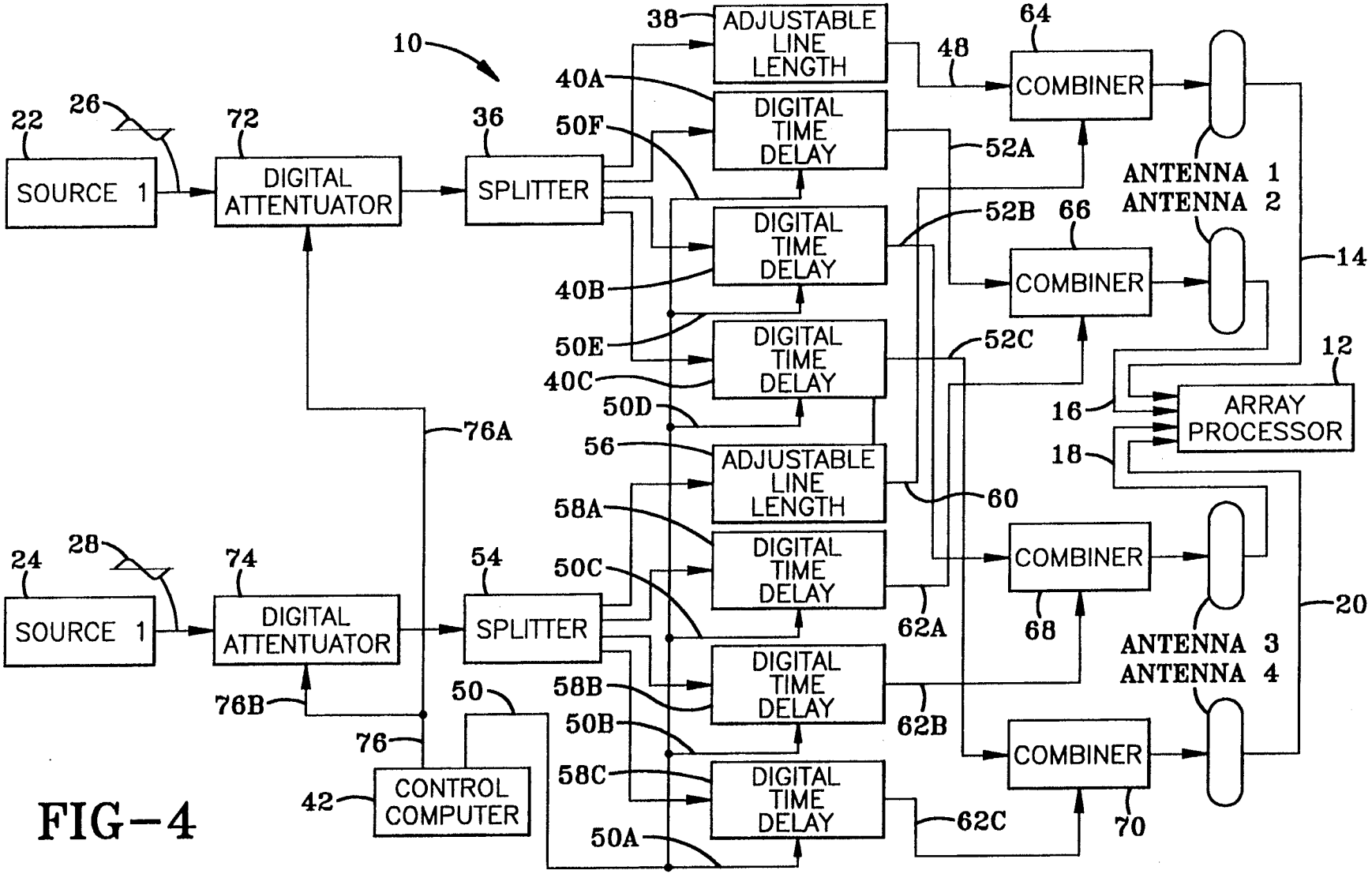
FIG. 4 is a block diagram, similar to FIG. 3, showing the interrelationship of the elements of the simulator of the present invention.

The operation and arrangement of the wavefront simulator 10 of FIG. 4 is similar to the operation and arrangement previously described for FIG. 3. FIG. 4 further illustrates a second source 24, generating another output signal 28, and signal paths 14, 16, 18 and 20 all previously described with reference to FIG. 1. The digital time delay 40 of FIG. 3 has been replaced by a family of digital time delays 40A, 40B and 40C that are respectively associated with antennas 2, 3 and 4 and each of which provides output signals 52A, 52B, and 52C, respectively. FIG. 4 also illustrates a second splitter 54 receiving its signal 28 originated from the second source 24, an adjustable line length device 56, and digital time delays 58A, 58B and 58C each of which output signals 62A, 62B and 62C respectively. The control signal 50 of the control computer 42 is also shown in FIG. 4 as having branches 50A, 50B, 50C, 50D, 50E and 50F that are respectively routed to digital time delay 58C, 58B, 58A, 40C, 40B, and 40A. Each control signal 50A, 50B, 50C, 50D, 50E and 50F are independent and may contain different control words.

FIG. 4 further illustrates combiners 64, 66, 68 and 70 that are respectively located on the input stage of antenna 1, 2, 3 and 4. FIG. 4 still further illustrates digital antenuators 72 and 74 respectively receiving signals from sources 1 and 2. The digital antenuators 72 and 74 are responsive to the control signal 76 generated by control computer 42 and having branches 76A and 76B that are respectively routed to digital antenuators 72 and 74.

Digital attenuators 72 and 74 operate in a similar manner as digital time delay 40 discussed with reference to FIG. 3 in response to the control computer 42. More particularly, the digital antenuators 72 and 74, in response to a second control signal 76, adjust the amplitude of the received signals from source 1 and 2 respectively. The digital antenuators 72 and 74, in response to the contents (preferably eight (8) bits) of the digital word of the control signal 76, provide an output signal to splitters 36 and 54, respectively, that has a variable amplitude. The antenuators 72 and 74 simulate different amplitude outputs of the signal present on each of the antenna elements 1, 2, 3 and 4, so as to simulate the effects caused by the differences in the signal amplitude across the array, for example, due to antenna shadowing, or line loss between the antenna outputs (signal paths 14, 16, 18 and 20) and the array processor 12. The digital antenuators 72 and 74 respectively route the first output signal from sources 1 and 2 to splitters 36 and 54 of FIG. 4.

The splitter 36 receives the first output signal 26 and splits it into four paths that are respectively routed to adjustable line length device 38, and digital time delays 40A, 40B, and 40C. Similarly, the splitter 54 receives the first output signal 28 and splits it into four paths that are respectively routed to adjustable line length device 56, and digital time delays 58A, 58B, and 58C. The adjustable line length device 38 develops an output signal 48 which is routed to combiner 64, and the adjustable line length device 56 also develops its respective output signal 60 which is also routed to combiner 64. Combiner 64 combines its two received signals and routes the composite signal to antenna 1.

Digital time delays 40A, 40B, and 40C, respectively generate their output signals 52A, 52B and 52C that are routed to combiners 66, 68 and 70. Similarly, the digital time delay 58A, 58B and 58C develop their output signals 62A, 62B, and 62C, which are respectively routed to combiners 66, 68, and 70. The combiners 66, 68 and 70 combine their respectively received signals and provide a composite signal which is applied to antennas 2, 3 and 4 respectively.

In operation, and in a manner as previously described with reference to FIG. 3, each of the adjustable line length devices 38 and 56 is set to a preselected time delay and, similarly, each of the time delays 40A, 40B, 40C, 58A, 58B, and 58C, are set to a predetermined time delay controlled by the first control signal 50 of the control computer 42. More particularly, each of the adjustable line length devices 38 and 56, as well as digital time delays 40A, 40B, 40C, 58A, 58B, and 58C, is individually selected for a predetermined time and the response of the array processor 12 is analyzed in accordance with the differential time delay signals supplied to the antennas 1, 2, 3 and 4. The circuit arrangement 10 of FIG. 4 provides a wavefront simulator 10 that emulates the RF signals that may be used to evaluate the response of the array processor 12 and which may be determined by expressions (4), (5), (6) and (7) respectively given below:

$$\Delta_{113}=T_{11}-T_{13}=1/c^*(D_{11}-D_{13}) \quad \text{Expression 4}$$

$$\Delta_{114}=T_{11}-T_{14}=1/c^*(D_{11}-D_{14}) \quad \text{Expression 5}$$

$$\Delta_{213}-T_{21}-T_{23}=1/c^*(D_{21}-D_{23}) \quad \text{Expression 6}$$

$$\Delta_{214}=T_{21}-T_{24}=1/c^*(D_{21}-D_{24}) \quad \text{Expression 7}$$

The notation given in the above expressions (4), (5), (6) and (7) is consistent with that of expressions (1), (2) and (3) and all of the time delays are referenced to antenna 1. The time delay between any two antennas can be calculated given the time delays between those antennas and antenna 1. For example, the time delay between antennas 2 and 3, associated with source 1 has a relationship that may be given by the below expression (8):

$$\Delta_{123}=\Delta_{113}-\Delta_{112} \quad \text{Expression 8}$$

Figure 5:
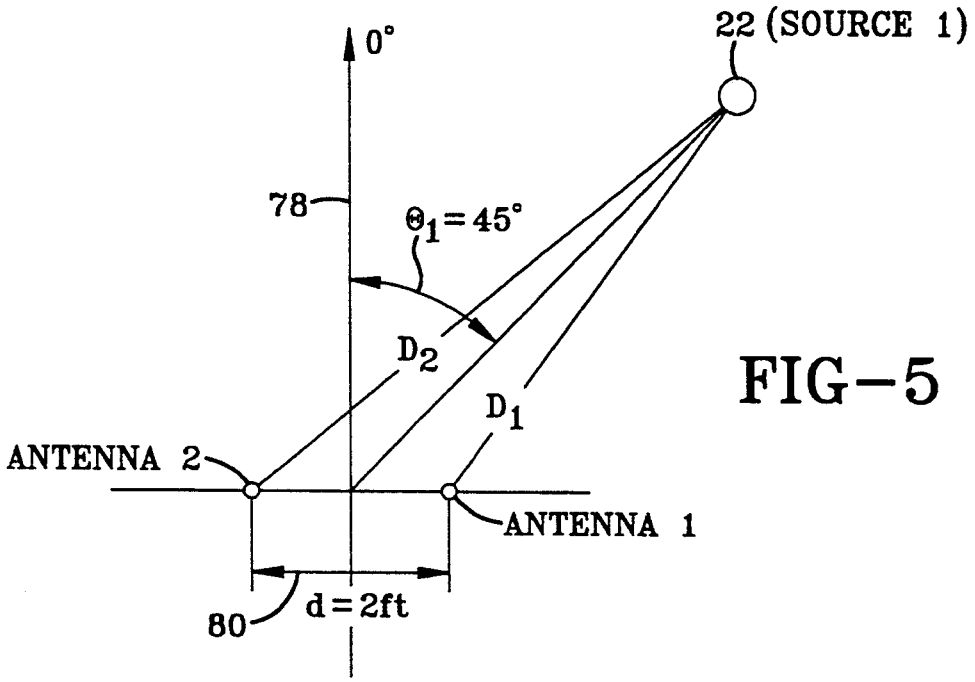
FIG. 5 is a schematic illustrating some of the accuracy considerations related to the present invention.

Some of the accuracy considerations of the wavefront simulator 10 may be first described with reference to FIG. 5. FIG. 5 illustrates the relationship between the error in the differential time delay between a signal transmitted by a single source, such as source 22 (source 1), and being intercepted by both antennas 1 and 2. Further, FIG. 5 illustrates that the error in the source angle of arrival depends upon where such a signal arrives relative to a reference point. Furthermore, these illustrated errors are dependent upon the spacing between the antennas, such as antenna 1 and 2. More particularly, FIG. 5 shows a line 78 extending upward from a midpoint between antenna 1 and antenna 2 and which serves as the 0° reference point from which is referenced the error in the angle of arrival $\theta$. As seen in FIG. 5, the central line emanating from source 22 intercepts the reference axis 78 and has an angle of arrival of $\theta$, =45°, whereas the lines $D_1$ and $D_2$, emanating from source 22 respectively intercept antennas 1 and 2, spaced apart from each other by a distance 80. As further seen in FIG. 5, as $\theta$ increases toward 90°, the error in the angle of arrival increases. Conversely, as $\theta$ decreases toward 0° (reference line 78), the angle is smaller.

During evaluation testing performed by the practice of this invention, the wavefront simulator 10 held the maximum spacing between antennas at 2 feet so that the maximum generated differential time delay of ±3.1 nanoseconds permitted evaluation of any orientation of the antennas 1, 2, 3 and 4 relative to a particular source. The 2 foot maximum spacing 80 is less than a half wavelength at the highest frequency of operation, thereby avoiding potential ambiguity problems in the angle of arrival measurements. The minimum step delay size of 24.4 picoseconds (discussed with reference to FIG. 3) yields a maximum possible ±12.2 picoseconds, which corresponds to a maximum angle of arrival error of less than ±0.5° for the geometry of FIG. 5. Also, a calibration (to be described) error of approximately 0.5° corresponds to an angle of arrival error of 0.3°. Thus, the total combined maximum error permitted by the wavefront simulator 10 is about 0.8°, but somewhat less on average for an antenna array having a 45° array offset angle. It should be noted that two out of the four antennas of the array may be selected to maintain an offset angle of no greater than 45°. Simulation testing made available by the wave front simulator 10 may be further described with reference to FIG. 6.

Figure 6:
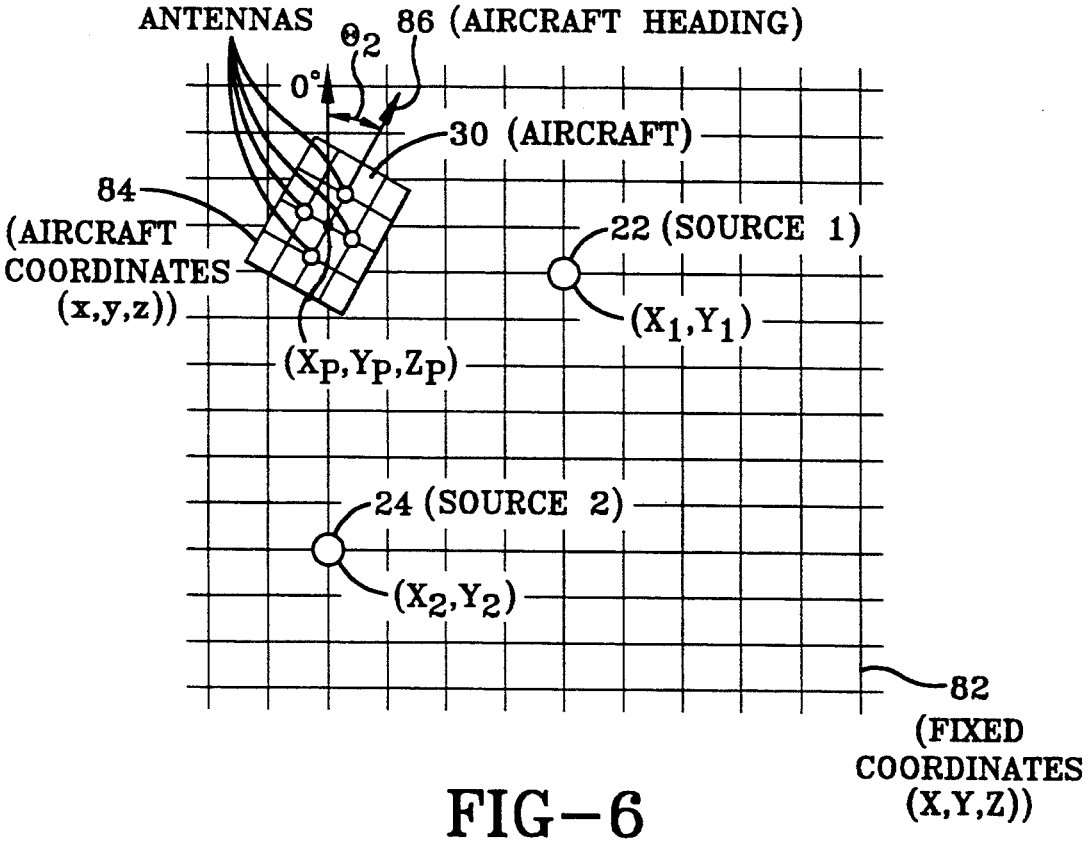
FIG. 6 illustrates the interrelationship between the fixed coordinates of the sources (transmitters) and the movable (aircraft) coordinates.

FIG. 6 illustrates two coordinate frames which are fixed coordinates (X,Y,Z) 82 and aircraft coordinates (x, y, z) 84 related to an aircraft 30 which, as shown in FIG. 6, has an aircraft heading 86 depicted as $\theta_2$. The wavefront simulator 10 to simulate the environment shown in FIG. 6 provides the time delay signals to array processor 12 whose response is analyzed by recording devices. To perform such analysis, the user first sets up a senario, typically inputted to a computer control 42 and requiring the following parameters: (a) the positions of the source 1 and 2; (b) the positions of antennas 1, 2, 3 and 4 relative to the aircraft 30; (c) the three dimensional positions (XYZ) related to the analysis being performed; the position of aircraft which may be specified by either a preprogrammed flight path (to be discussed) or by fly-to-points path (to be discussed), whereas the heading of the aircraft 30 is automatically computed by an application program being run in the control computer 42; (d) the velocity of the aircraft 30; and (e) the frequency of the signal 26 and 28 being transmitted by sources 1 and 2 respectively. Furthermore, with reference to FIG. 6, the computer control 42 requires the position of each of the antennas relative to the aircraft in (x, y, z) coordinates. In addition, the position of the aircraft 30 (including heading for static testing to be described) and the position of source 1 and 2 need to be specified in fixed rectangular (X, Y, Z) coordinate frame 82 parameters. The aircraft rectangular coordinates 84 move and rotate with the aircraft 30.

Given the aircraft coordinate frame 84, the aircraft heading 86 and the fixed rectangular coordinate frame 82 (all shown in FIG. 6); the distances from the source 1 and 2 to the antennas 1, 2, 3 and 4 may be calculated. The position of antenna i in the aircraft coordinate frame 84 is ($x_{ai}$, $Y_{ai}$, $Z_{ai}$). The position of the antenna i in the fixed coordinate frame 82 is ($X_{ai}$, $Y_{ai}$, $Z_{ai}$) and which has a relationship that may be given by the below expression (9):

Expression 9

$$\begin{bmatrix} X_{ai} \\ Y_{ai} \end{bmatrix} = \begin{bmatrix} \cos(\Theta_2) & \sin(\Theta_2) \\ -\sin(\Theta_2) & \cos(\Theta_2) \end{bmatrix} \begin{bmatrix} x_{ai} \\ y_{ai} \end{bmatrix} + \begin{bmatrix} X_p \\ Y_p \end{bmatrix}$$

$$Z_{ai} = z_{ai} + Z_p$$

where ($X_p$, $Y_p$, $Z_p$) is the position of the aircraft in the fixed rectangular coordinate frame 82 and $\theta_2$ is the aircraft heading 86 relative to a reference axis.

The position of source j in the fixed rectangular coordinate frame 82 is ($X_j$, $Y_j$). The distance from source j to antenna i has the following relationship that may be given by expression (10):

Expression 10

$$D_{ji} = \sqrt{(X_{ai} - X_j)^2 + (Y_{ai} - Y_j)^2 + (Z_{ai})^2}$$

Expression 10 is used to compute the distances given by equations (2), (3), (4), (5), (6), (7) and (8). The wavefront simulator 10 is used to provide for static and dynamic testing, wherein the static testing may be further described with reference to FIG. 7.

Figure 7:
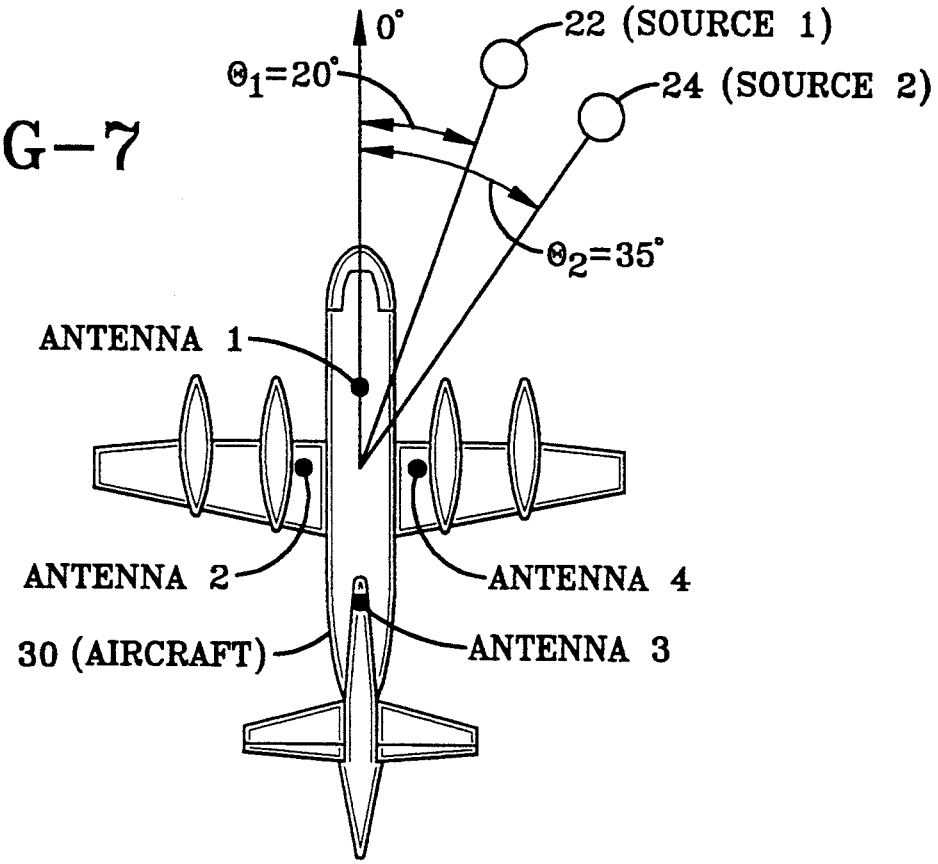
FIG. 7 is a schematic illustrating the interrelationship involved with the static testing of the present invention.

FIG. 7 illustrates an aircraft 30 having antenna 1, 2, 3 and 4 each located at a fixed location thereon. Further, FIG. 7 illustrates source 22 (source 1) and 24 (source 2) arranged relative to the 0° reference heading of the aircraft 30 so as to respectively have an angle of arrival $\theta_1$ of 20° and $\theta_2$ of 35°. For the static testing illustrated in FIG. 7, the sources 1 and 2 and the antenna array, comprised of antennas 1, 2, 3 and 4, remain fixed (i.e., the aircraft 30 does not move). To generate this environment, expressions (4), (5), (6), and (7) are computed only once. The digital word contained in the first control signal 50 that is sent to digital time delays 40A, 40B, 40C, 58A, 58B and 58C remain unchanged for the duration of this static testing. This type of static testing measures the performance of an array processor 12 at one specific point. For these tests, the signal levels adjustable by digital antennuator 72 and 74 can be fixed at any value. The dynamic testing capabilities provided by the wavefront simulator 10 may be further described with reference to FIG. 8.

Figure 8:
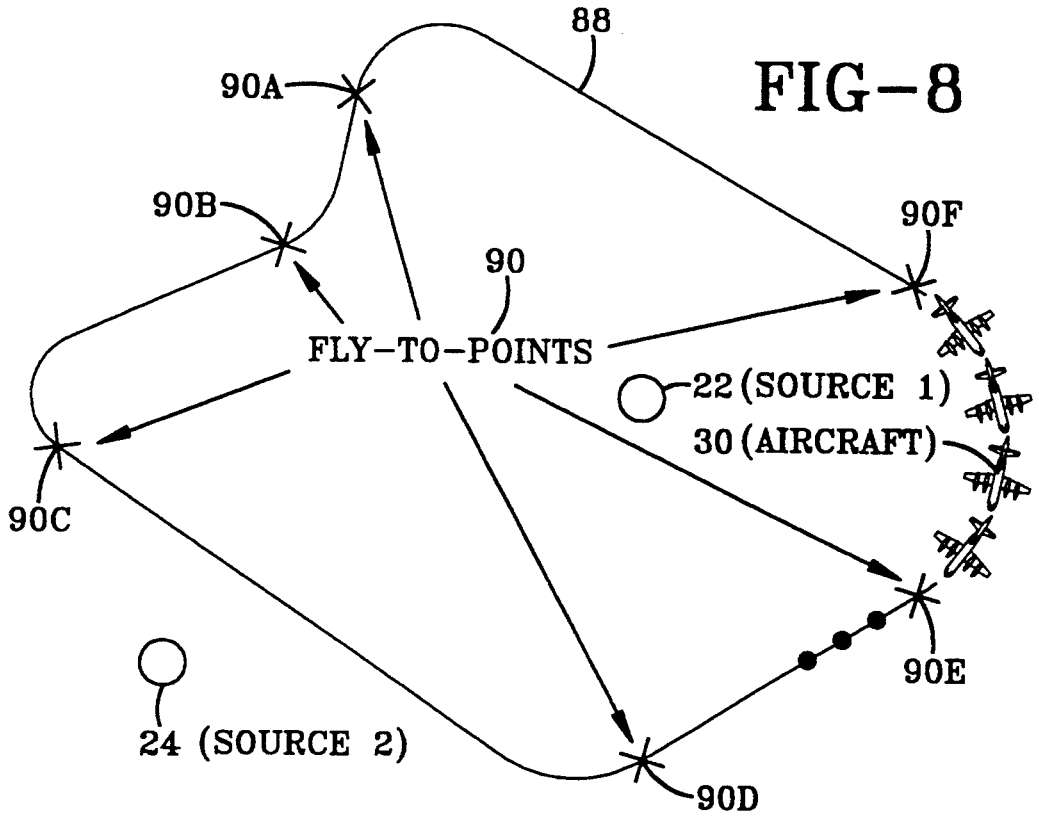
FIG. 8 is a schematic illustrating the interrelationship involved with the dynamic testing of the present invention.

For dynamic testing, the positions of the sources 22 (source 1) and 24 (source 2) remain fixed, but the aircraft 30 moves and rotates in a predetermined pattern, e.g., a predetermined continuous path 88 defining a line or a circle, or fly-to-points path 90 illustrated by a family of reference numbers 90A, 90B, 90C, 90D, 90E and 90F, as shown in FIG. 8. The distances (and hence delay times), given by expressions (2), (3), (5), (6), (7) and (8) change continuously. For the dynamic testing illustrated in FIG. 8, the aircraft flight path (88 or 90) is digitized into small discreet steps, and at each such step the control computer 42 updates the time delays and the digital antenuators 72 and 74. Although update rates as high as 1,000 Hz may be employed, the typical rate is 100 Hz which is sufficiently high to avoid the so called, undesirable "granularity" effects for the aircraft ground speed and flight paths. In a manner as discussed with reference to FIG. 7, the positions of the four antennas located on the aircraft 30 of FIG. 8 is entered into the control computer 42, followed by the positions of the two sources 22 and 24 within their fixed rectangular coordinate frame 82. The fly-to-points 90 are connected by a smooth path. As the plane 30 is simulated to fly along the path (continuous path 88 or fly-to-points path 90), the heading, and hence the orientation of the antenna array, comprising of antennas 1, 2, 3 and 4, is changed and is automatically taken into account in the analysis being performed by the control computer 42. For the dynamic testing, the time delays (established by elements 40A, 40B, 40C, 58A, 58B and 58C) emulated at antennas 1, 2, 3 and 4 and the power levels (established by the digital antenna antenuators 72 and 74) are continuously updated. The signals developed by the wavefront simulator 10 and applied to the array processor 12 represent an RF environment that is generated by a programmed scenario under the control of the control computer 42 with reliance on the recording device 32 discussed with reference to FIG. 2.

It should now be appreciated that the practice of the present invention provides for a wavefront simulator that allows for an array processor 12 to be evaluated for both its static and dynamic capabilities.

In addition to providing the necessary time differential signals to evaluate the array processor 12, the wavefront simulator 10 also has features that make it amenable to calibration and such features may be described with reference to FIG. 9.

Figure 9:
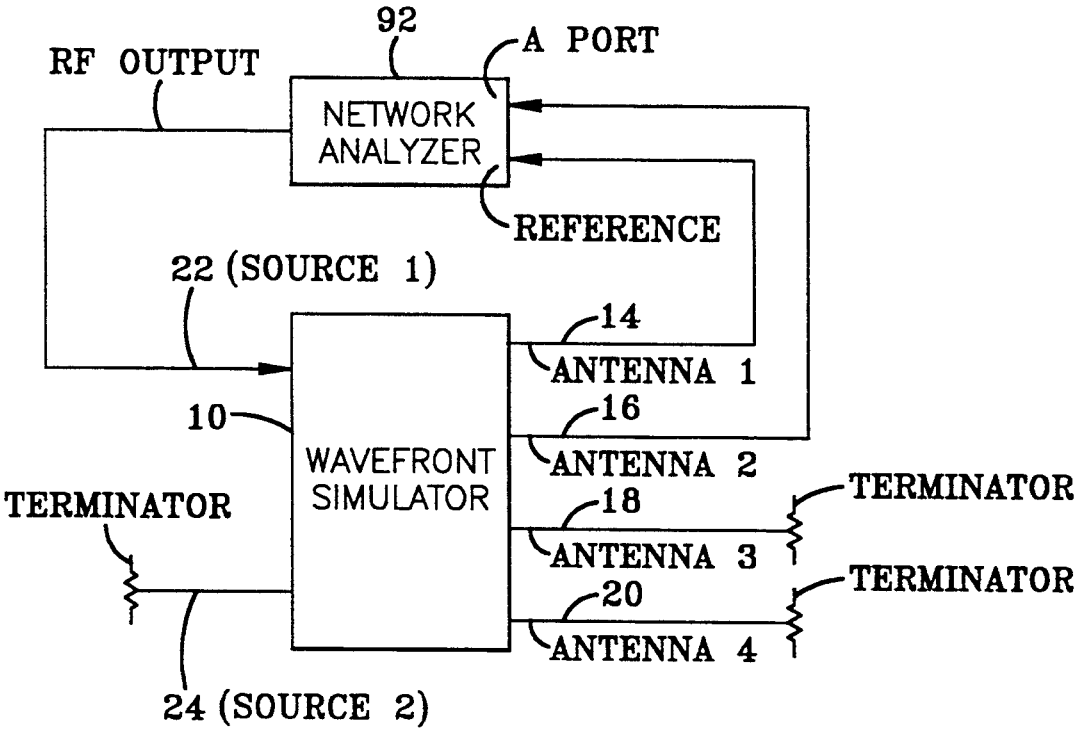
FIG. 9 illustrates a block diagram of the interconnections between the equipments involved in the calibration of the wavefront simulator of the present invention.

FIG. 9 illustrates the interconnections between the wavefront simulator 10 and a network analyzer 92 so that a calibration procedure may be performed to verify that the wave front simulator 10 provides the correct time delay between antennas 1, 2, 3 and 4. As seen in FIG. 9, the signal paths 14 and 16 (antennas 1 and 2) are respectively routed to the A port and reference inputs of the network analyzer 92 which, in turn, supplies the wavefront simulator 10 with its RF output, acting as the first output signal 26 generated by source 22 (source 1). The normal input from source 24 (source 2) is terminated with a 50 ohm terminator as are also signal paths 18 (antenna 3) and 20 (antenna 4).

The network analyzer 92 does not measure time delays, but instead it is configured to measure the phase difference between its A port (antenna 1) and its reference (antenna 2). The phase difference, in degrees, between antenna 1 and i (shown as antenna 2) is related to the time difference by the below expression (11):

$$P_{1i}=360^{\circ}*f*\Delta_{1i} \qquad \text{Expression 11}$$

where $P_{1i}$ is the phase difference between antenna 1 and antenna i, f is the frequency of the transmitter (the network analyzer frequency during calibration), and $\Delta_{1i}$ is the time delay between antenna 1 and antenna i calculated from expressions (4), (5), (6) and (7). As previously mentioned the range of time delays between the antennas is from −3,125 nanoseconds to 3,101 nanoseconds and is provided in 24.4 picosecond steps. For a source (1 or 2) frequency of 160 MHz, the possible range of phase shifts is from −180° to +178.6°, in 1.4° steps. If the frequency of the source (1 or 2) is different from 160 MHz, the possible range of phase shift values changes accordingly.

During the calibration procedure, the computer control 42 sends digital words 50 to the time delay networks 40A of FIG. 4 that controls the differential delay between antenna 2 and 1 for source 1 (expression (2)). The network analyzer 92 measures the phase angle and stores the measured value. The measurement will not be exactly −180° because of the variations in system components and small variations in the adjustable line length device 38. The control computer 42 next sends an appropriate second digital word 50 to the digital time delay 40A and the measurement is repeated. The phase angle should incrementally increase by about 1.4°, but again, its increase may be slightly different due to component variations. The process is repeated by sending digital words to the time delays 40B, 40C, 58A, 58B, and 58C and measuring the corresponding phase shifts. This process develops a calibration table for the phase difference between antennas 1 and 2 at the frequency of source 1 and an example of such is given in the below Table 2.

TABLE 2

| Digital Word | Phase Difference |
|---|---|
| 0 | −180.8° |
| 1 | −178.0° |
| . | . |
| . | . |
| . | . |
| 170 | +58.2° |
| 171 | +59.7° |
| . | . |
| . | . |
| . | . |
| 255 | +187.1° |

Appropriate digital words for source 2 and another antenna, such as antenna 3, may be applied to the appropriate equipment and the resulting phase shift may be measured by the network analyzer 92 to check for correlation between sources (1 and 2) and antennas (1, 2, 3 and 4).

In the practice of the present invention the wavefront simulator 10 was calibrated several times a day over several days. During this period of time, the calibration tables were compared and the maximum variations between tables were less than 0.5°. This corresponds to a maximum aircraft to source uncertainty of approximately 0.3° at worst-case angles of arrival.

It should now be appreciated that the practice of the present invention not only provides for a wavefront simulator 10 that provides the time delay signals so that the array processor 12 may be accurately analyzed, but also provides features that allow the wavefront simulator 10 to be accurately calibrated so that the accuracy of evaluation of the signal processor 12 may be periodically assured.

For dynamic testing, the update rate determines how often the digital words are sent to the digitally controlled time delays 40A, 40B, 40C, 58A, 58B, and 58C. In order for there to be a smooth transition between time delays, the update rate must be sufficiently high. For a typical dynamic flight scenario, such as discussed with reference to FIG. 8, the time difference between antennas changes at a maximum rate of 1.5 nanoseconds every second. Since the time delays are changed in 24.4 picosecond increments, the update rate must be greater than 1.56 nanoseconds/sec/24.4 psec =65 points per second. This update ensures that the error in the time delays between the antennas 1, 2, 3 and 4 at each point in the flight (88 or 90) is no greater than 24.4 psec.

Another concern with simulating the dynamic flight is that all the time delays between antennas 1, 2, 3 and 4 need to be changed simultaneously. In order to accomplish this, all the time delay data is calculated prior to the performance of a dynamic test simulation. The data is first loaded into the memory unit of the control computer 42 and then down loaded with a parallel distribution data system that clocks the loaded data out simultaneously. Such an operation is not important for the static testing, such as that described with reference to FIG. 7.

It should now be appreciated that the practice of the present invention provides for a wavefront simulator that provides time delay signals that are accurate so as to allow for the proper analysis of an array processor 12.

Many modifications or variations of the present invention are possible in view of the above disclosure. It is therefore to be understood, that within the scope of the appending claims, the invention may be practiced otherwise as specifically described.

What I claim is:

1. A simulator that emulates the RF signals needed to evaluate a RF communication array signal processor, said simulator comprising:

(a) at least one splitter receiving a first output signal at a predetermined frequency in the megahertz range and splitting said first output signal into a plurality of second output signals;

(b) at least one adjustable delay line receiving one of said second output signals and having a preselected time delay, said adjustable time delay developing a third output signal that is made available to a RF communication array signal processor; and (c) at least one digital delay line receiving one of said output second signals and being responsive to a first control signal for selecting a predetermined time delay, said digital delay line developing a fourth output signal that is also made available to said RF communication array signal processor;

(d) at least one digital antenuator receiving said first output signal and routing said first output signal to said at least one splitter, said at least one digital antenuator being responsive to a second control signal for selecting a predetermined antenuation of said respective first output signal.

2. A simulator that emulates the RF signals needed to evaluate a RF communication array signal processor, said simulator comprising:

(a) at least one splitter receiving a first output signal at a predetermined frequency in the megahertz range and splitting said first output signal into a plurality of second output signals;

(b) at least one adjustable delay line receiving one of said second output signals and having a preselected time delay, said adjustable time delay developing a third output signal that is made available to a RF communication array signal processor;

(c) at least one digital delay line receiving one of said output second signals and being responsive to a first control signal for selecting a predetermined time delay, said digital delay line developing a fourth output signal that is also made available to said RF communication array signal processor;

(d) a plurality of antennas forming an array and wherein the first of which receives said third signal developed by each of said adjustable delay lines and the remainder of which receive said fourth output signals respectively developed by digital delay lines; and (e) a combiner for each of said plurality of antennas and receiving said respective third and fourth output signals.

3. A simulator that emulates the RF signals needed to evaluate a RF communication array signal processor, said simulator comprising:

(a) at least one splitter receiving a first output signal at a predetermined freguency in the megahertz range and splitting said first output signal into a plurality of second output signals, said first output signal being generated by a source having fixed X and Y coordinates;

(b) at least one adjustable delay line receiving one of said second output signals and having a preselected time delay, said adjustable time delay developing a third output signal that is made available to a RF communication array signal processor; and (c) at least one digital delay line receiving one of said output second signals and being responsive to a first control signal for selecting a predetermined time delay, said digital delay line developing a fourth output signal that is also made available to said RF communication array signal processor.

4. The simulator according to claim 1, wherein said first and second control signals are generated by a control computer, said first control signal comprising an eight (8) bit word having a bit weight of 24.4 picoseconds, said eight (8) bit first control word establishing the differential time between said third and fourth output signals.

5. A method of emulating RF signals needed to evaluate a RF communication array signal processor's capability of processing and responding to time delay signals received from an array of multiple antennas, said method comprising the steps of:

(a) providing at least one first output signal at a predetermined frequency in the megahertz (MHz) band;

(b) providing at least one splitter receiving said at least one first output signal and splitting said first output signal into a plurality of second output signals;

(c) providing at least one adjustable delay line receiving one of said second output signals and having a preselected time delay, said adjustable delay developing a third output signal which serves as a signal received by a first antenna of said array of multiple antennas;

(d) providing at least one digital delay line receiving one of said second output signals and being responsive to a first control signal for selecting a predetermined time delay, said digital delay line developing a fourth output signal which serves as a signal received by the remaining antennas of said array of multiple antennas;

(e) providing a recorder for monitoring the response of said RF communication array signal processor;

(f) selecting said adjustable delay line to a first predetermined time delay;

(g) selecting said first control signal to be an eight (8) bit word corresponding to a second predetermined delay which exceeds said first predetermined time delay and monitoring the response of said RF communication signal array processor to determine if the fourth output signal is interpreted as being emitted from a first source which is further away than a second source which is emitting said third signal; and (h) repeating step (g) for a range of second predetermined values which are greater than and less than said first predetermined time delay and monitoring the response of said RF communication array signal processor to determine its response to said third signal and said fourth output signal; and (i) providing a combiner for each of said antennas of said array for receiving said one or more third signals routed to said first antenna and said one or more fourth signals routed to each of said remaining antennas.

6. A method of emulating RF signals needed to evaluate an RF communication array signal processor's capability of processing and responding to time delay signals received from an array of multiple antennas, said method comprising the steps of:

(a) providing at least one first output signal at a predetermined frequency in the megahertz (MHz) band;

(b) providing at least one splitter receiving said at least one first output signal and splitting said first output signal into a plurality of second output signals;

(c) providing at least one digital antenuator receiving said first output signal and routing said first output signal to said at least one splitter, said at least one digital antenuator being responsive to a second control signal for selecting a predetermined antenuation of said respective first output signals;

(d) providing at least one adjustable delay line receiving one of said second output signals and having a preselected time delay, said adjustable delay developing a third output signal which serves as a signal received by a first antenna of said array of multiple antennas;

(e) providing at least one digital delay line receiving one of said second output signals and being responsive to a first control signal for selecting a predetermined time delay, said digital delay line developing a fourth output signal which serves as a signal received by another antenna of said array of multiple antennas;

(f) providing a recorder for monitoring the response of said RF communication array signal processor;

(g) selecting said adjustable delay line to a first predetermined time delay;

(h) selecting said first control signal to be an eight (8) bit word corresponding to a second predetermined delay which exceeds said first predetermined time delay and monitoring the response of said RF communication signal array processor to determine if the fourth output signal is interpreted as being emitted from a first source which is further away than a second source which is emitting said third signal;

(i) repeating step (h) for a range of second predetermined values which are greater than and less than said first predetermined time delay and monitoring the response of said RF communication array signal processor to determine its response to said third signal and said fourth output signal; and (j) varying said second control word and monitoring the response of said RF communication array signal processor to determine its response to said third signal and said fourth output signal each having a different amplitude.

* * * * *